US012440005B1

(12) United States Patent
Troy

(10) Patent No.: US 12,440,005 B1
(45) Date of Patent: Oct. 14, 2025

(54) ADJUSTABLE WATCHBAND

(71) Applicant: Marcus L. Troy, White oak, NC (US)

(72) Inventor: Marcus L. Troy, White oak, NC (US)

( * ) Notice: Subject to any disclaimer, the term of this patent is extended or adjusted under 35 U.S.C. 154(b) by 0 days.

(21) Appl. No.: 19/005,829

(22) Filed: Dec. 30, 2024

(51) Int. Cl.
*A44C 5/20* (2006.01)

(52) U.S. Cl.
CPC ..... *A44C 5/2057* (2013.01)

(58) Field of Classification Search
CPC ..... A44C 5/2057; A44C 5/14; A44C 5/246; A44C 5/18; A44C 5/22; A44C 5/2076; G04B 37/0008; G04B 37/1486; G04B 37/14; G04B 37/18
USPC ..... 368/282
See application file for complete search history.

(56) References Cited

U.S. PATENT DOCUMENTS 1,749,036 A * 3/1930 Kuehne ..... A44C 5/24 224/176
1,764,440 A * 6/1930 Gammell ..... A44C 5/22 24/68 J
1,786,943 A * 12/1930 Gammell ..... A44C 5/22 24/574.1
1,876,443 A * 9/1932 Armbrust ..... A44C 5/24 24/71 J
1,893,271 A * 1/1933 Carlson ..... A44C 5/246 24/71 J
2,004,206 A * 6/1935 Kestenman ..... A44C 5/246 24/71 J
2,042,154 A * 5/1936 Johnson ..... A44C 5/246 24/71 J
2,160,316 A * 5/1939 Ritter ..... A44C 5/24 24/71 J
2,444,360 A * 6/1948 Mauch ..... A44C 5/246 24/71 J
2,542,358 A * 2/1951 Ritter ..... A44C 5/246 D11/87
4,541,151 A * 9/1985 Herchenbach ..... A44C 5/2057 24/174
6,944,916 B2 * 9/2005 Kawagoe ..... A44C 5/246 24/70 J
9,581,972 B1 2/2017 Arrow et al.
10,258,115 B2 4/2019 Novak
10,809,666 B2 10/2020 Markan et al.
2014/0375246 A1 12/2014 Boysen, III et al.
2015/0115870 A1 4/2015 Vance
2019/0286068 A1 9/2019 Helled
2019/0365062 A1 12/2019 Kelly
2023/0030001 A1 * 2/2023 Di Piazza ..... A44C 5/246

* cited by examiner

*Primary Examiner* — Jason W San
*Assistant Examiner* — Louis A Mercado

(57) ABSTRACT

An adjustable watchband is disclosed. The watchband includes a first band portion and a second band portion. The first band portion comprises a plurality of adjustment slots, a push button, a push button sliding space, a connector, and a connector sliding space. The push button is adapted to shift between the plurality of adjustment slots. The connector is adapted to slide together with the push button. The second band portion comprises a second securing member and at least one positioning hole. The second securing member is configured to engage the first securing member to releasably secure the second band portion to the first band portion. The at least one positioning hole is adapted to receive the at least one positioning pin.

16 Claims, 17 Drawing Sheets

ADJUSTABLE WATCHBAND

FIELD OF THE INVENTION

The present invention relates generally to a watchband that can be attached to any mechanical or digital timepiece or wearable device.

BACKGROUND OF THE INVENTION

A watchband is typically used to apply a watch or other wearable devices to the wearer's wrist. Watchbands are available in a variety of sizes, shapes, colors and styles. Some watchbands are in the form of a rigid bracelet that fits loosely around the wearer's wrist. Other watchbands are in the form of interconnected links that can be tightened around a wearer's wrist, either mechanically through a clasp or elastically. Still other watchbands are in the form of a pair of straps that attach to opposite sides of the watch case. The straps can be wrapped around a wearer's wrist and their free ends can be secured to one another by a buckle, hook and loop fastener, snap fastener, or other connector.

Despite the variety of watchbands currently available, there is a need for a watchband that can be easily and quickly applied to and removed from a wearer's wrist.

SUMMARY OF THE INVENTION

The present invention discloses an adjustable watchband. The watchband comprises a first band portion and a second band portion. The first band portion has a first end and second end and comprises a plurality of adjustment slots, a push button, a push button sliding space, a connector, and a connector sliding space. The plurality of adjustment slots is located adjacent to the first end. The push button is adapted to shift between the plurality of adjustment slots. The push button comprises a push button body having a top surface and a bottom surface and a shaft extending from the bottom surface. The push button sliding space is located beneath the plurality of adjustment slots. The push button sliding space is configured to allow the push button body to reciprocate within the push button sliding space when the push button is being pressed down. The connector is adapted to slide together with the push button. The connector comprises a base, a tongue portion extending from the base toward the first end, and at least one positioning pin also extending from the base toward the first end. The base comprises a receptacle to receive the shaft. The tongue portion comprises a first securing member. The connector sliding space is configured to allow the connector to reciprocate within the connector sliding space. The second band portion has a first end and a second end and comprises a second securing member and at least one positioning hole. The second securing member is located at the first end of the second band portion and configured to engage the first securing member to releasably secure the first end of the second band portion to the first end of the first band portion. The at least one positioning hole is adapted to receive the at least one positioning pin.

In one embodiment, the first band portion further comprises an outer layer positioned above the plurality of adjustment slots. The outer layer comprises a cutout portion to allow a wearer to access the push button.

In one embodiment, the push button further comprises a raised portion extending from the top surface of the push button body. The raised portion traveles through the cutout portion of the outer layer.

In one embodiment, the push button further comprises a resilient member biased to urge the push button to the plurality of adjustment slots.

In one embodiment, the resilient member includes a spring around the shaft.

In one embodiment, the receptacle includes a recess in the base of the connector.

In one embodiment, the plurality of adjustment slots is parallel to each other.

In one embodiment, the plurality of adjustment slots includes six adjustment slots.

In one embodiment, the first band portion further comprises a shaft sliding space located between the push button sliding space and the connector sliding space and configured to allow the shaft of the push button to reciprocate within the shaft sliding space.

In one embodiment, the shaft sliding space is narrower than the push button sliding space and the connector sliding space.

In one embodiment, the first band portion further comprises at least one pin hole at the first end of the first band portion.

In one embodiment, the tongue portion extends from a middle portion of the base.

In one embodiment, the at least one positioning pin includes two positioning pins with one positioning pin on each side of the tongue portion.

In one embodiment, the first band portion further comprises an end cutout portion for the tongue portion of the connector.

In one embodiment, the at least one positioning hole includes two positioning holes with one positioning hole on each side of the second securing member.

In one embodiment, the second end of the first band portion and the second end of the second band portion each comprise a watch attachment mechanism configured to attach the first band portion and the second band portion to an external device, respectively.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the present invention. That is, the dimensions of the components of the present invention, independently and in relation to each other can be different. It should be noted that the drawings are schematic and not necessarily drawn to scale. Some drawings are enlarged or reduced to improve drawing legibility.

DETAIL DESCRIPTIONS OF THE INVENTION

Figure 1:
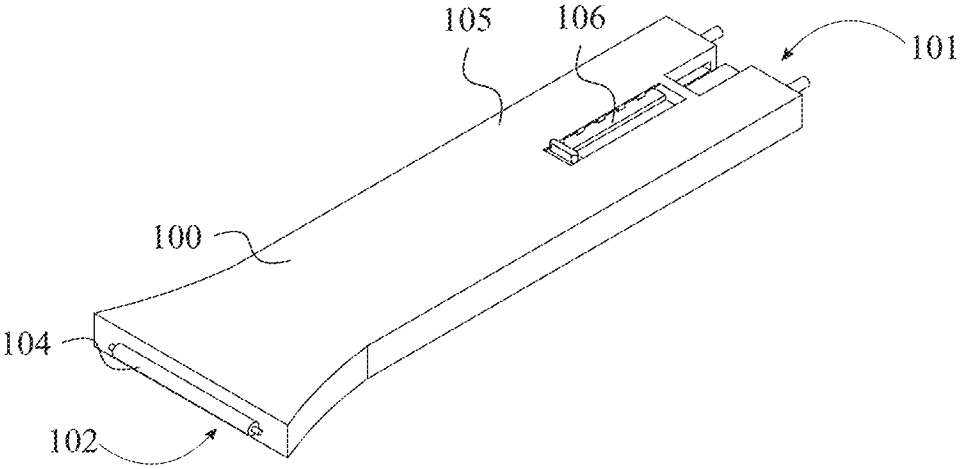
FIG. 1 depicts a perspective view of a first band portion of the present invention.
Figure 2:
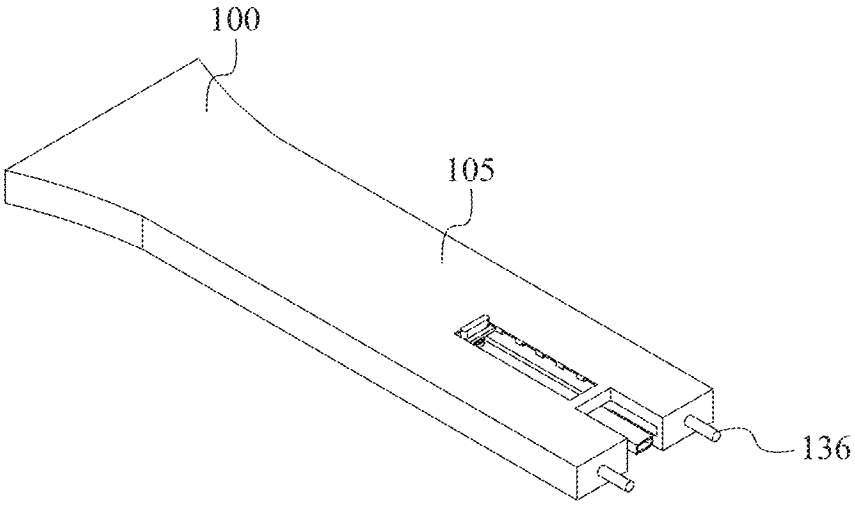
FIG. 2 depicts another perspective view of the first band portion of the present invention.
Figure 3:
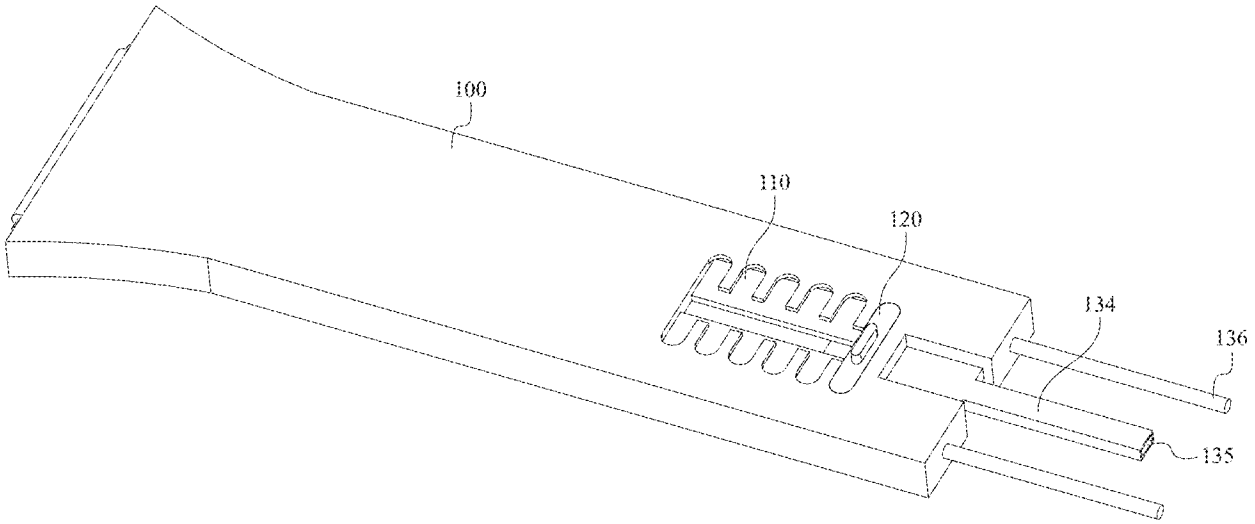
FIG. 3 depicts a perspective view of the first band portion of the present invention, wherein the outer layer is removed.
Figure 4:
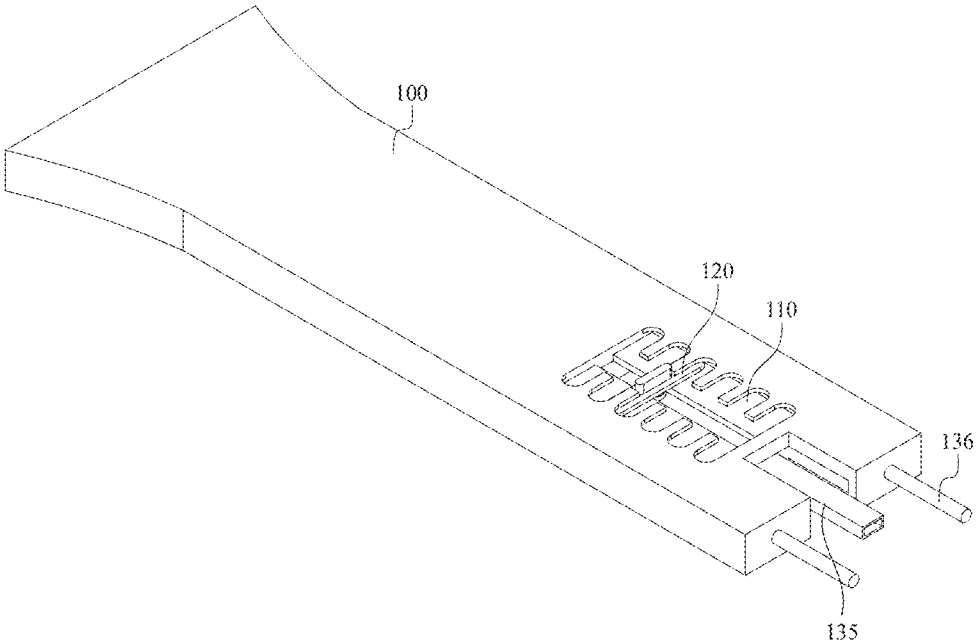
FIG. 4 depicts a perspective view of the first band portion of the present invention, wherein the outer layer is removed, and the push button is pressed down.
Figure 5:
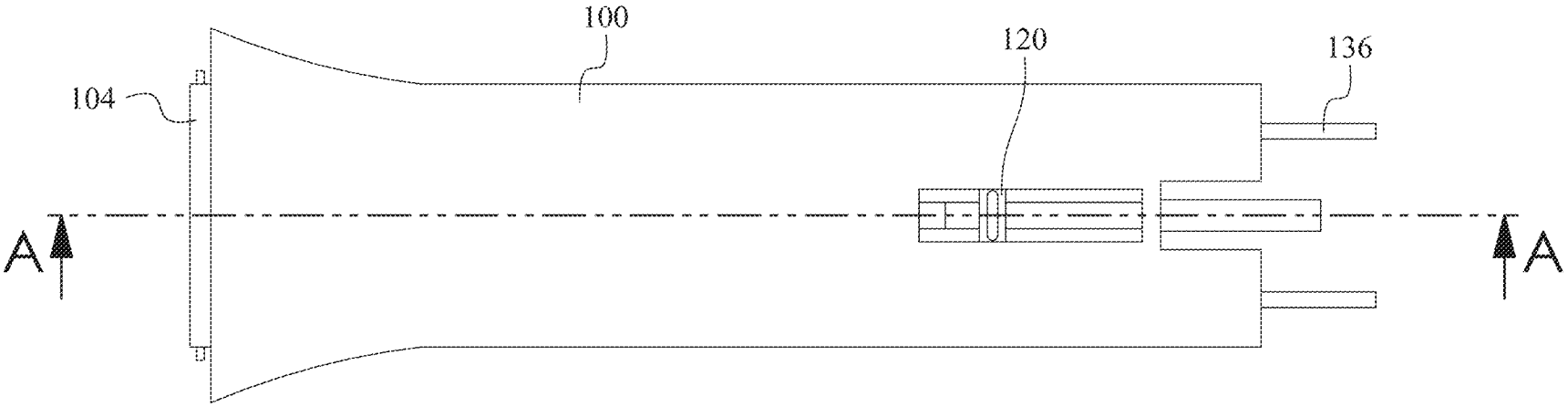
FIG. 5 depicts a top view of the first band portion of the present invention.
Figure 6:
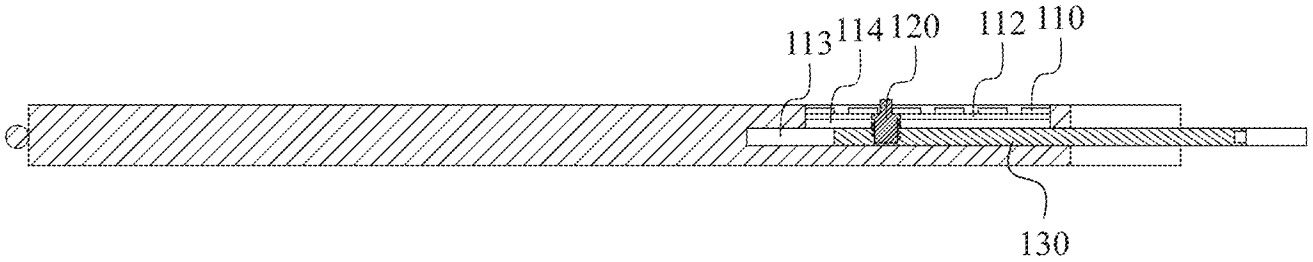
FIG. 6 depicts a cross-sectional view of the present invention, taken along the line A-A in FIG. 5.
Figure 7:
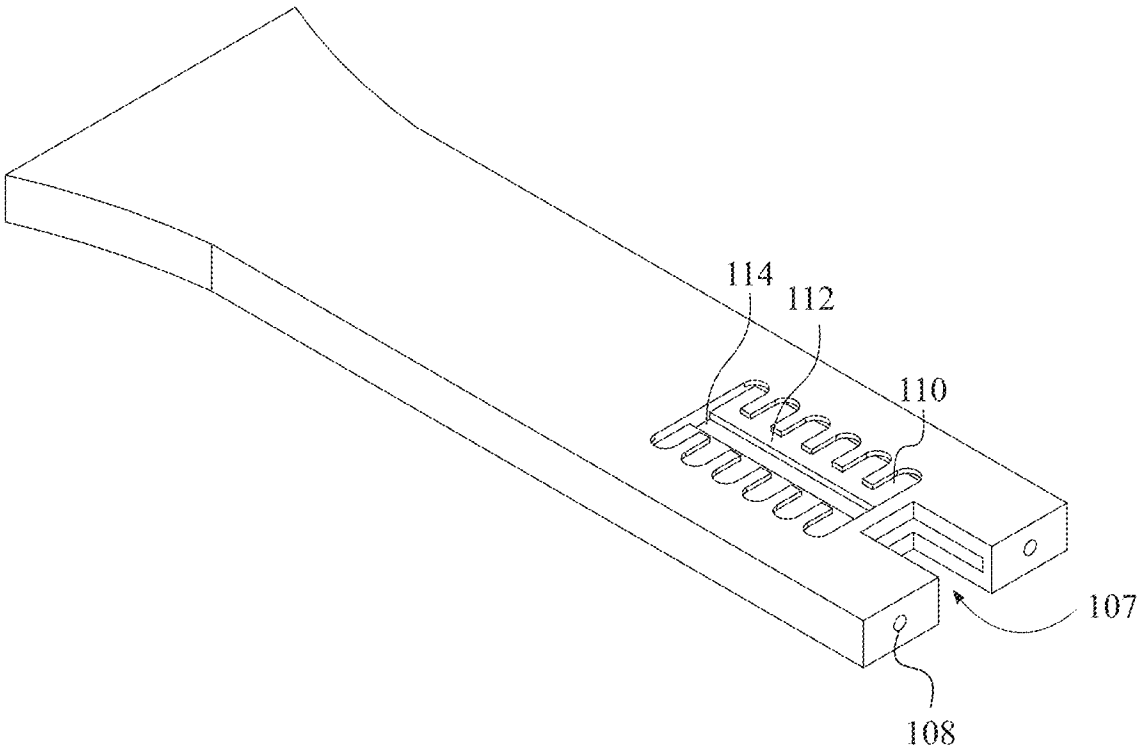
FIG. 7 depicts a perspective view of the first band portion of the present invention, wherein the outer layer, the push button, and the connector are removed.
Figure 8:
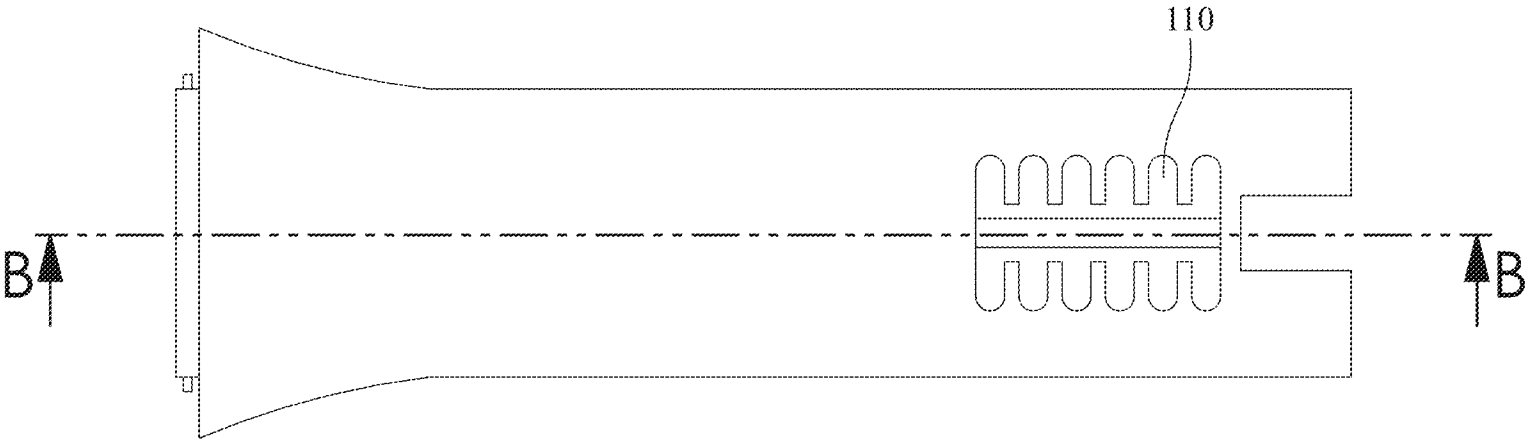
FIG. 8 depicts a top view of the first band portion of the present invention, wherein the outer layer, the push button, and the connector are removed.
Figure 9:
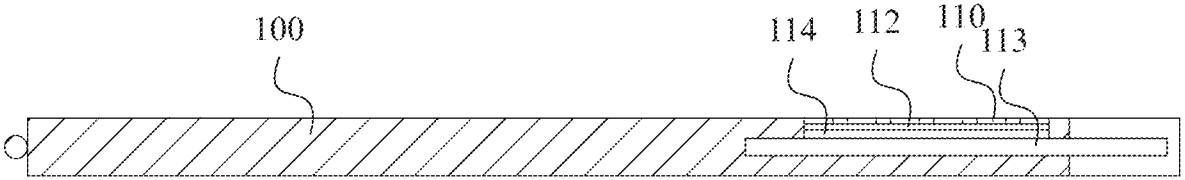
FIG. 9 depicts a cross-sectional view of the present invention, taken along the line B-B in FIG. 8.
Figure 10:
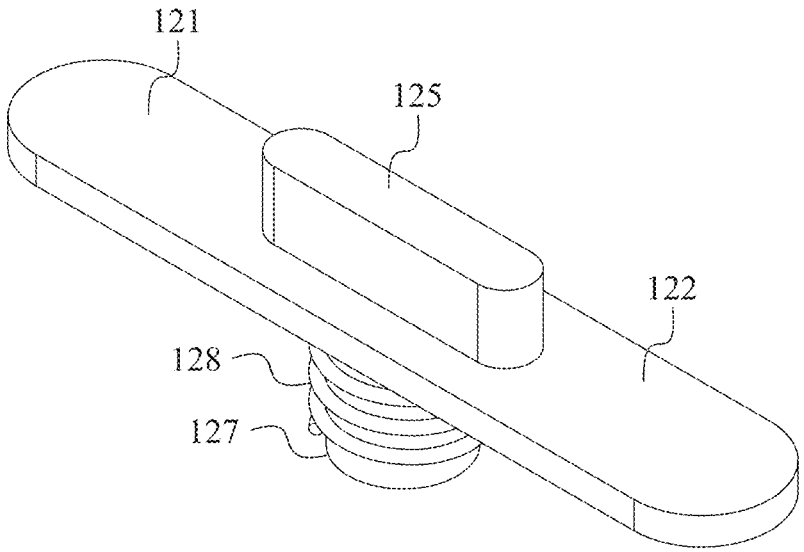
FIG. 10 depicts a perspective view of the push button of the present invention.
Figure 11:
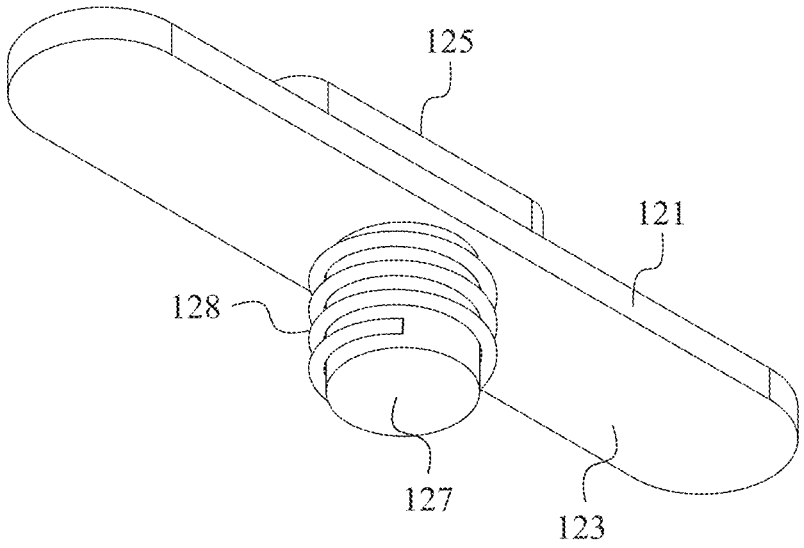
FIG. 11 depicts another perspective view of the push button of the present invention.
Figure 12:
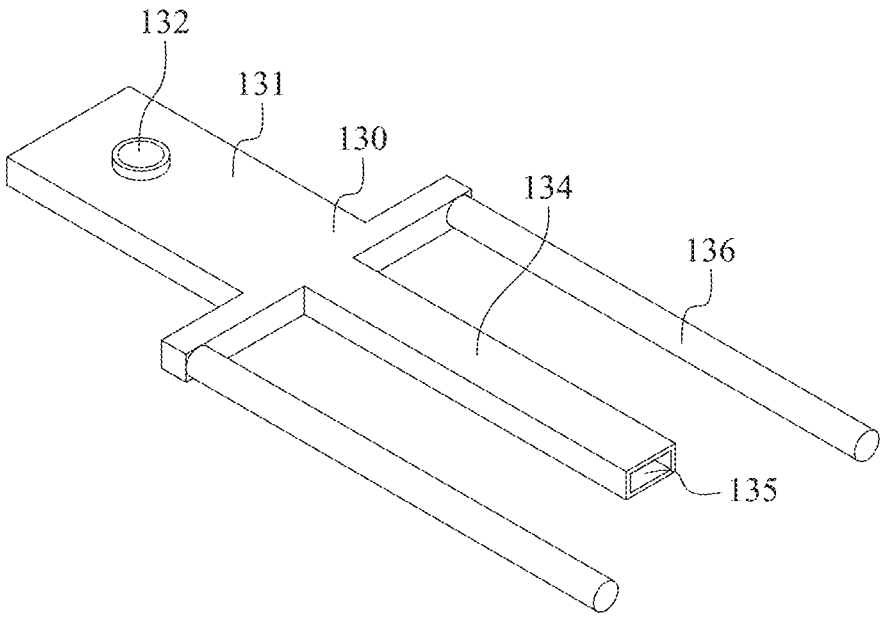
FIG. 12 depicts a perspective view of the connector of the present invention.
Figure 13:
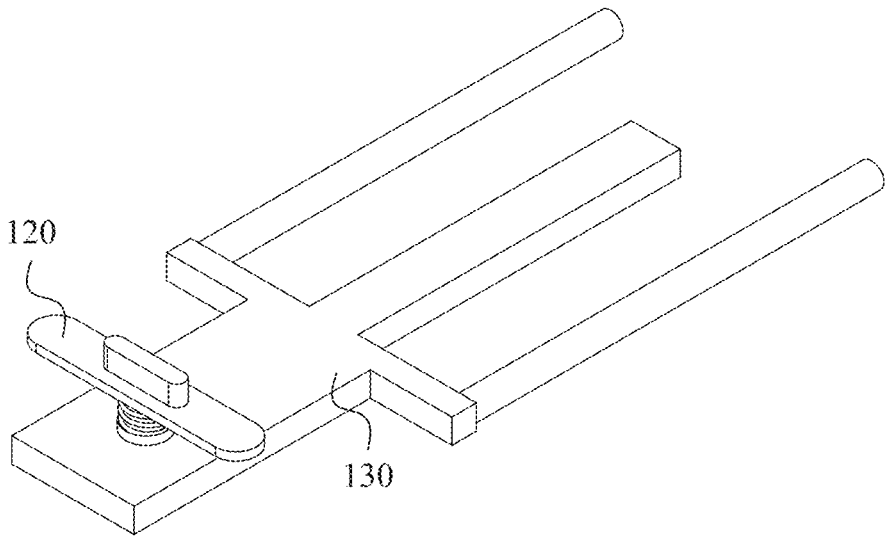
FIG. 13 depicts a perspective view of the assembled push button and connector of the present invention.
Figure 14:
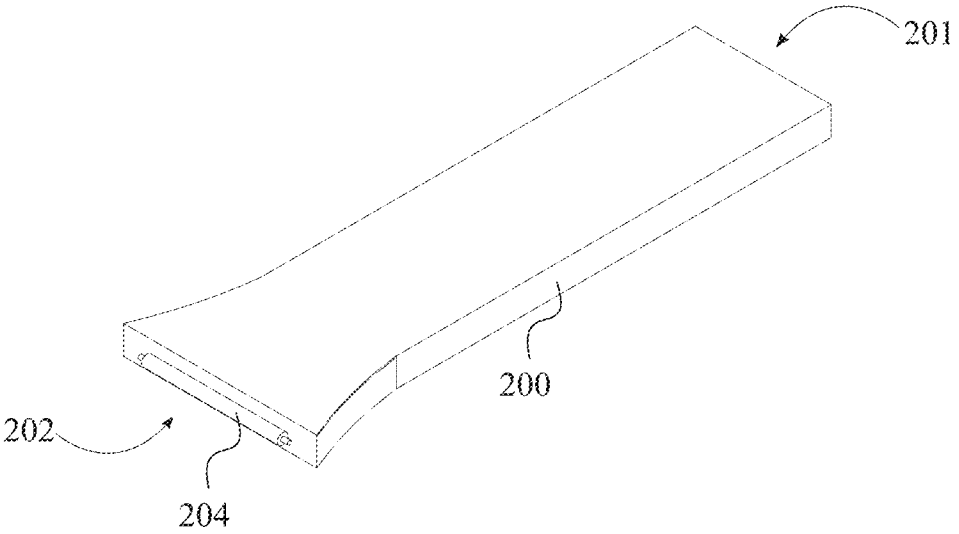
FIG. 14 depicts a perspective view of a second band portion of the present invention.
Figure 15:
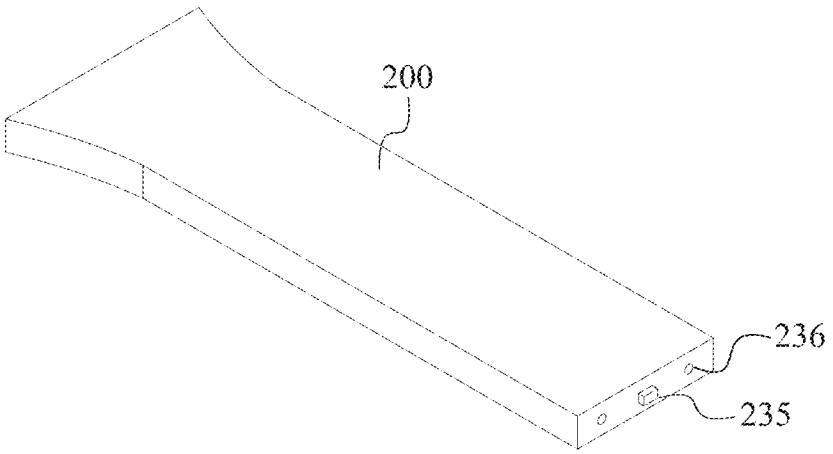
FIG. 15 depicts another perspective view of the second band portion of the present invention.
Figure 16:
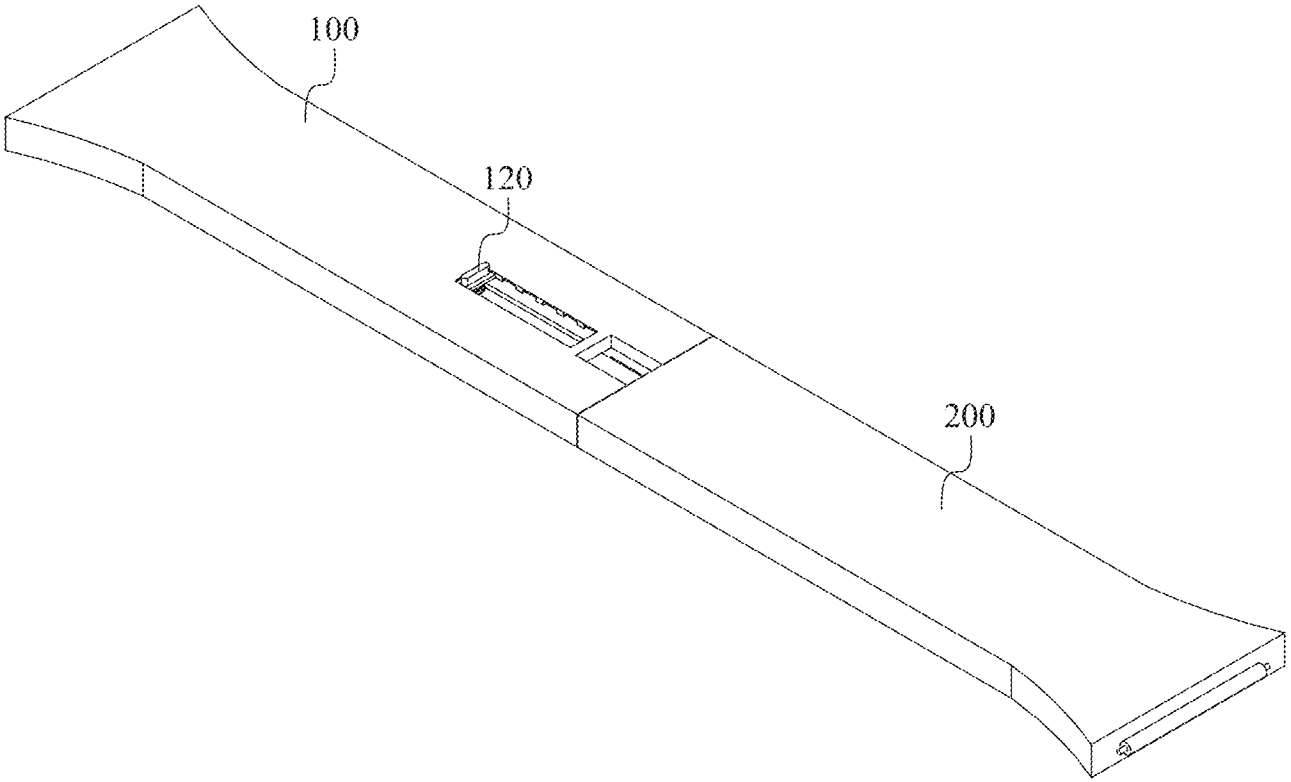
FIG. 16 depicts a perspective view of the present invention, wherein the first band portion and the second band portion are attached together, and the watchband is adjusted to its shortest length.
Figure 17:
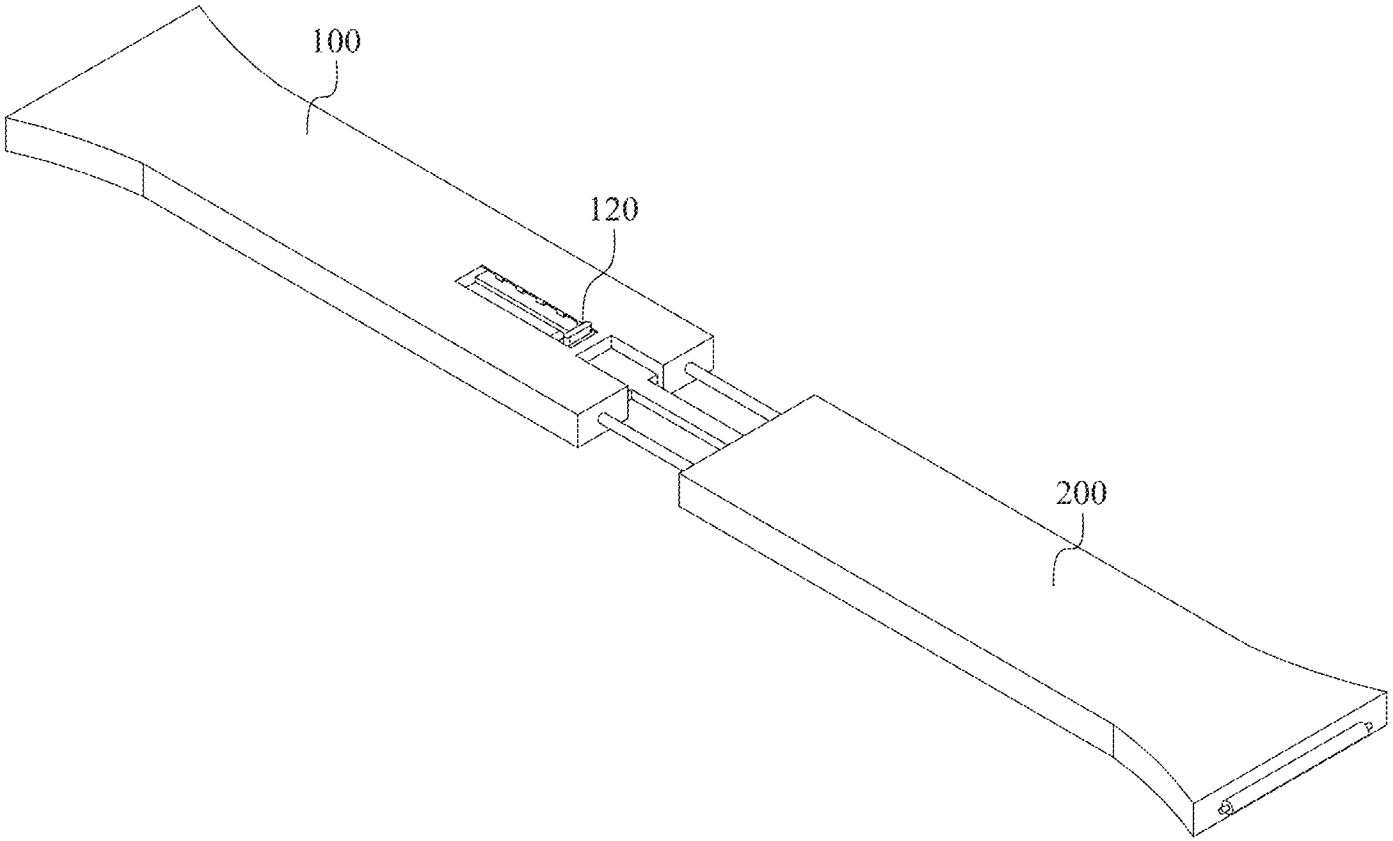
FIG. 17 depicts a perspective view of the present invention, wherein the first band portion and the second band portion are attached together, and the watchband is adjusted to its longest length.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and is made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. When not explicitly defined herein, to the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list." The following detailed description refers to the accompanying drawings.

Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "proximate" refers to positions that are situated close/near in relationship to a structure. As used in the following description, the term "distal" refers to positions that are situated away from positions.

The present disclosure includes many aspects and features. Moreover, while many aspects and features relate to, and are described in the context of watchbands, embodiments of the present disclosure are not limited to use only in this context.

The present invention is a watchband that is adapted to attach a watch or a wearable device to a wearer's wrist by joining free ends of the watchband together. It is an aim of the present invention to provide a watchband that allows a wearer to easily adjust the length of the watchband.

Referring now to the figures of the present disclosure. The adjustable watchband of the present invention comprises a first band portion 100 and a second band portion 200.

The first band portion 100 is an elongated member that is adapted to partially wrap around a wearer's wrist. It should be noted that the first band portion 100 can be of any shape, size, material, features, type or kind, orientation, location, quantity, components, and arrangements of components that would allow the present invention to fulfill the objectives and intents of the present invention. In one embodiment, the first band portion 100 has a first end 101 and a second end 102. The first end 101 of the first band portion 100 is a free end that will be attached to the second band portion 200, while the second end 102 of the first band portion 100 will be fixedly or releasably attached to a conventional watch or a wearable device. The first band portion 100 comprises a plurality of adjustment slots 110, a push button 120, a push button sliding space 112, a connector 130, and a connector sliding space 113.

The plurality of adjustment slots 110 is located adjacent to the first end 101. The plurality of adjustment slots 110 is configured to receive the push button 120 and prevent it from sliding once engaged. Each adjustment slot is shaped and sized to receive and conform to the contour of the push button body 123 of the push button 120. For example, the adjustment slot may have a shape that is similar to the push button body 123 but is slightly larger than the push button body 123. In the illustrated embodiment, both the plurality of adjustment slots 110 and the push button body 123 have an oval rectangular shape. It should be noted that the plurality of adjustment slots 110 and the push button body 123 may take any desired geometrical shapes including but not limited to squares, rectangles, circles, ovals, or any other regular or irregular polygons. In a preferred embodiment, the plurality of adjustment slots 110 is parallel to each other. In another preferred embodiment, the plurality of adjustment slots 110 includes six adjustment slots. However, the number of adjustment slots can vary to provide different adjustment ranges, depending on the design requirements. In one embodiment, the first band portion may comprise an outer layer 105 positioned above the plurality of adjustment slots 110 to restrict the push button body 123 within the first band portion 100. The outer layer 105 comprises a cutout portion 106 to allow the wearer to access the push button 120.

The push button 120 is adapted to shift between the plurality of adjustment slots in order to adjust the overall length of the watchband of the present invention. The push button 120 comprises a push button body 121 having a top surface 122 and a bottom surface 123 and a shaft 127 extending from the bottom surface 123. The push button body 121 can be received within the plurality of adjustment slots 110 and thus prevented from unintended movement. The push button body 121 may also be pressed down so that it could be repositioned to another adjustment slot. To facilitate this, the push button sliding space 112 is located beneath the plurality of adjustment slots 110 and configured to allow the push button body 123 to reciprocate within the push button sliding space 112 when the push button is being pressed down. In one embodiment, the push button 120 may further comprise a raised portion 125 extending from the top surface 122 of the push button body 121. The raised portion 125 travels through the cutout portion 106 of the outer layer 105, enabling the wearer to easily manipulate the push button 120. In one embodiment, the push button further comprises a resilient member 128 biased to urge the push button 120 to the plurality of adjustment slots 110. In a preferred embodiment, the resilient member 128 includes a spring around the shaft 127. This configuration ensures that the push button body 121 naturally rests within one of the adjustment slots 110. To adjust the watchband length, the wearer simply presses the push button 120 downward and slides it to a different adjustment slot.

The connector 130 is adapted to slide together with the push button 120. The connector 130 comprises a base 131, a tongue portion 134 extending from the base 131 toward the first end 101, and at least one positioning pin 136 also extending from the base toward the first end 101. In one embodiment, the base 131 comprises a receptacle 132 to receive the shaft 127 of the push button 120. In a preferred embodiment, the receptacle 132 includes a recess in the base 131 of the connector 130. In this way, when the wearer presses downward and slides the push button 120, the connector 130 will slide along with the push button 120. The tongue portion 134 comprises a first securing member 135 that is configured to attach the first band portion 100 to the second band portion 200.

The connector sliding space 113 is configured to allow the connector 130 to reciprocate within the connector sliding space 113. In one embodiment, the first band portion 100 further comprises a shaft sliding space 114 located between the push button sliding space 112 and the connector sliding space 113 and configured to allow the shaft 127 of the push button 120 to reciprocate within the shaft sliding space 114. In one embodiment, the shaft sliding space 114 is narrower than the push button sliding space 112 and the connector sliding space 113. This design ensures that the connector 130 remains confined within the connector sliding space 113, while the push button 120 stays restricted to the push button sliding space 112.

In one embodiment, the tongue portion 134 extends from a middle portion of the base 130. The at least one positioning pin 136 includes two positioning pins with one positioning pin on each side of the tongue portion 134. In one embodiment, the first band portion 100 further comprises an end cutout portion 107 for the tongue portion 134 of the connector 130. The end cutout portion 107 allows the wearer to secure or release the attachment means between the first band portion and the second band portion. In one embodiment, the first band portion 100 further comprises at least one pin hole 108 at the first end 101 of the first band portion 100 to allow the at least one positioning pin 136 to pass through.

The second band portion 200 is also an elongated member that is adapted to wrap around a wearer's wrist in conjunction with the first band portion 100. It should be noted that the second band portion 200 can be of any shape, size, material, features, type or kind, orientation, location, quantity, components, and arrangements of components that would allow the present invention to fulfill the objectives and intents of the present invention. In one embodiment, the second band portion 200 has a first end 201 and a second end 202. The second band portion 200 comprises a second securing member 235. The second securing member 235 is located at the first end 201 of the second band portion 200 and configured to engage the first securing member 135 to releasably secure the first end 201 of the second band portion 200 to the first end 101 of the first band portion 100. It should be noted that the first securing member 135 and the second securing member 235 can be attached together via any suitable mechanisms including but not limited to frictional attachment, magnets, magnets, snap-button, button and loop, hook and loop or combinations thereof. The at least one positioning hole 236 is adapted to receive the at least one positioning pin 136. In a preferred embodiment, the at least one positioning hole 236 includes two positioning holes with one positioning hole on each side of the second securing member 235. The at least one positioning hole 236 and the at least one positioning pin 136 allow for an easy alignment of the first ends of the two band portions. In one embodiment, the second end 102 of the first band portion 100 and the second end 202 of the second band portion 200 each comprise a watch attachment mechanism 104 or 204 configured to attach the first band portion 100 and the second band portion 200 to an external device, respectively. The external device may be a mechanical or digital watch or any other suitable wearable device.

It is envisioned that the sizes of the components forming the present invention such as the first band portion 100, the second band portion 200, and/or any subassemblies or subcomponents can vary based on design requirements.

Although the disclosure has been explained in relation to its preferred embodiment, it is to be understood that many other possible modifications and variations can be made without departing from the spirit and scope of the disclosure.

What is claimed is:

1. An adjustable watchband comprising:

a first band portion having a first end and second end and comprising:

a plurality of adjustment slots located adjacent to the first end;

a push button adapted to shift between the plurality of adjustment slots, the push button comprising a push button body having a top surface and a bottom surface and a shaft extending from the bottom surface;

a push button sliding space located beneath the plurality of adjustment slots, the push button sliding space being configured to allow the push button body to reciprocate within the push button sliding space when the push button is being pressed down;

a connector adapted to slide together with the push button, the connector comprising a base, a tongue portion extending from the base toward the first end, and at least one positioning pin also extending from the base toward the first end, the base comprising a receptacle to receive the shaft, the tongue portion comprising a first securing member;

a connector sliding space configured to allow the connector to reciprocate within the connector sliding space;

a second band portion having a first end and a second end and comprising:

a second securing member located at the first end of the second band portion and configured to engage the first securing member to releasably secure the first end of the second band portion to the first end of the first band portion;

at least one positioning hole adapted to receive the at least one positioning pin.

2. The adjustable watchband as claimed in claim 1, wherein the first band portion further comprises an outer layer positioned above the plurality of adjustment slots, the outer layer comprising a cutout portion to allow a wearer to access the push button.

3. The adjustable watchband as claimed in claim 2, wherein the push button further comprises a raised portion extending from the top surface of the push button body, the raised portion traveling through the cutout portion of the outer layer.

4. The adjustable watchband as claimed in claim 3, wherein the push button further comprises a resilient member biased to urge the push button to the plurality of adjustment slots.

5. The adjustable watchband as claimed in claim 4, wherein the resilient member includes a spring around the shaft.

6. The adjustable watchband as claimed in claim 1, wherein the receptacle includes a recess in the base of the connector.

7. The adjustable watchband as claimed in claim 1, wherein the plurality of adjustment slots is parallel to each other.

8. The adjustable watchband as claimed in claim 7, wherein the plurality of adjustment slots includes six adjustment slots.

9. The adjustable watchband as claimed in claim 1, wherein the first band portion further comprises a shaft sliding space located between the push button sliding space and the connector sliding space and configured to allow the shaft of the push button to reciprocate within the shaft sliding space.

10. The adjustable watchband as claimed in claim 9, wherein the shaft sliding space is narrower than the push button sliding space and the connector sliding space.

11. The adjustable watchband as claimed in claim 1, wherein the first band portion further comprises at least one pin hole at the first end of the first band portion.

12. The adjustable watchband as claimed in claim 11, wherein the tongue portion extends from a middle portion of the base.

13. The adjustable watchband as claimed in claim 12, wherein the at least one positioning pin includes two positioning pins with one positioning pin on each side of the tongue portion.

14. The adjustable watchband as claimed in claim 13, wherein the first band portion further comprises an end cutout portion for the tongue portion of the connector.

15. The adjustable watchband as claimed in claim 13, wherein the at least one positioning hole includes two positioning holes with one positioning hole on each side of the second securing member.

16. The adjustable watchband as claimed in claim 1, wherein the second end of the first band portion and the second end of the second band portion each comprise a watch attachment mechanism configured to attach the first band portion and the second band portion to an external device, respectively.

* * * * *